US012054231B1

(12) United States Patent
Shields

(10) Patent No.: US 12,054,231 B1
(45) Date of Patent: Aug. 6, 2024

(54) LOWER BODY GARMENT WITH INFLATABLE FLOTATION DEVICE

(71) Applicant: JMS IP, LLC, Mobile, AL (US)

(72) Inventor: John Marshall Shields, Mobile, AL (US)

( * ) Notice: Subject to any disclaimer, the term of this patent is extended or adjusted under 35 U.S.C. 154(b) by 111 days.

(21) Appl. No.: 17/966,596

(22) Filed: Oct. 14, 2022

(51) Int. Cl.
*B63C 9/125* (2006.01)
*A41D 13/012* (2006.01)
*B63C 9/105* (2006.01)

(52) U.S. Cl.
CPC ..... *B63C 9/105* (2013.01); *A41D 13/0125* (2013.01); *B63C 9/1255* (2013.01)

(58) Field of Classification Search
CPC ..... B63C 9/105; B63C 9/1055; B63C 9/1255; B63C 9/155; A41D 13/012; A41D 13/0125
See application file for complete search history.

(56) References Cited

U.S. PATENT DOCUMENTS 3,094,723 A * 6/1963 Manhart ..... B63C 9/1255 441/127
3,119,132 A 12/1964 Nayar
4,560,356 A 12/1985 Burr
4,813,899 A 3/1989 Fujimoto
5,368,512 A 11/1994 Brown
5,702,279 A 12/1997 Brown
6,036,562 A 3/2000 Brown
6,231,411 B1 * 5/2001 Vinay ..... B63C 9/155 441/88
7,305,715 B2 * 12/2007 Orsos ..... A41D 7/003 441/108
7,937,770 B1 * 5/2011 Hernandez ..... A41D 7/005 441/120
9,446,826 B2 9/2016 Fuhrhop et al.
10,035,572 B1 * 7/2018 Armendariz ..... B63C 9/155
2006/0270290 A1 11/2006 Tellew
2007/0117479 A1 5/2007 Weinel et al.
2008/0257643 A1 10/2008 Weinel et al.
2009/0130933 A1 5/2009 Andrea et al.
2011/0097953 A1 * 4/2011 Steger ..... B63C 9/1255 441/106
2013/0014310 A1 1/2013 Tang
2014/0179182 A1 * 6/2014 Jenney ..... A41D 7/005 441/120

(Continued)

FOREIGN PATENT DOCUMENTS

BR PI0601597-2 A 12/2007
CA 2231040 A1 11/1998

(Continued)

*Primary Examiner* — Andrew Polay
(74) *Attorney, Agent, or Firm* — AdamsIP, LLC; Stephen Thompson; J. Hunter Adams

(57) ABSTRACT

A lower body garment that includes an inflatable flotation device and a method of using the garment for flotation are provided. The flotation device is integrated with the garment and can be inflated in case of emergency in water. The garment is designed to be worn as a typical lower body garment when the flotation device is deflated and to convert into a life jacket that can be harnessed to a user's upper body and inflated to provide flotation. The garment includes straps that are designed to be used as both a garment belt when worn on the lower body and as harness straps when used for flotation.

20 Claims, 11 Drawing Sheets

(56) References Cited

U.S. PATENT DOCUMENTS

| | | | | |
|---|---|---|---|---|
| 2014/0273678 | A1 | 9/2014 | Meyer | |
| 2017/0081001 | A1 | 3/2017 | Bosacco | |
| 2018/0110265 | A1* | 4/2018 | Symon | A41D 13/0125 |
| 2020/0023927 | A1 | 1/2020 | Gruentzig | |

FOREIGN PATENT DOCUMENTS

| | | | |
|---|---|---|---|
| CA | 2285826 | A1 | 4/2000 |
| CN | 203416826 | U | 2/2014 |
| CN | 103799567 | A | 5/2014 |
| CN | 203969265 | U | 12/2014 |
| CN | 106213608 | A | 12/2016 |
| CN | 108308745 | A | 7/2018 |
| CN | 110395371 | A | 11/2019 |
| DE | 1113434 | B | 9/1961 |
| DE | 2415518 | A1 | 10/1974 |
| DE | 3723257 | A1 | 1/1989 |
| DE | 102009028016 | A1 | 1/2011 |
| DE | 102012016964 | A1 | 3/2014 |
| EP | 805764 | A1 | 11/1997 |
| FR | 2772713 | A1 | 1/2000 |
| FR | 2808660 | A1 | 8/2002 |
| FR | 3022213 | A1 | 12/2015 |
| FR | 3022524 | A1 | 12/2015 |
| MX | 04002794 | A | 6/2005 |
| TW | 201521615 | A | 6/2015 |
| WO | 2005060703 | A2 | 7/2005 |
| WO | 2006054972 | A2 | 5/2006 |
| WO | 2007141421 | A2 | 12/2007 |
| WO | 2012093292 | A1 | 7/2012 |
| WO | 2014031821 | A2 | 2/2014 |
| WO | 2015011629 | A9 | 1/2015 |
| WO | 2016064762 | A1 | 4/2016 |
| WO | WO-2016180039 | A1 * | 11/2016 |
| WO | 2018075073 | A1 | 4/2018 |

* cited by examiner

LOWER BODY GARMENT WITH INFLATABLE FLOTATION DEVICE

FIELD OF THE INVENTION

The present disclosure relates generally to a lower body garment that has an inflatable flotation device that is integrated with the garment and that can be inflated and worn as a life vest for flotation in water.

BACKGROUND

Lifesaving personal flotation devices (PFDs) for emergency use in water come in many forms all with the same purpose of providing buoyancy in water to prevent drowning. The simplest types of PFDs are life vests having a buoyant foam body. Life vests are worn on the torso of a user and provide buoyancy should the user fall into the water. Inflatable life jackets are also commonly used. These types of life jackets are generally less bulky than foam vests when worn by a user. Inflatable devices include one or more air chambers that inflate when necessary. The air chambers generally cover the breast of the user's torso and extend across the shoulders and around the back of the user's neck to provide adequate buoyancy. The air chambers may inflate upon activation of a carbon dioxide cartridge or manually via a blow tube. In some cases, inflation may occur automatically by various mechanisms designed to activate upon a user entering the water in order to prevent drowning if a user is unconscious.

The use of PFDs is particularly important in situations where individuals are participating in water-based activities such as boating. However, PFD wear rates are extremely low across nearly all categories, including open motorboats, sailboats and paddlecraft. PFD wear rates have remained low despite decades of outreach programs, by both government and private entities, intended to increase awareness about the importance of wearing a PFD while engaged in boating and other water-based activities. Although regulations require all marine vessels to have PFDs onboard, they are very often not worn by vessel occupants. It would thus be advantageous to provide a garment with an integrated inflatable flotation device that is worn by a user at all times and that can be activated by the user to provide flotation whenever needed.

SUMMARY

In one aspect, a garment having an integrated inflatable flotation device and a method of using the garment to provide flotation are provided. The garment comprises a wearable garment portion and a flotation device attached to the garment portion. The flotation device comprises and inflatable bladder. The garment is configured to convert between a garment configuration in which the garment is worn on a user's lower body and a flotation configuration in which the flotation device is harnessed to the user's upper body. When in the garment configuration, the inflatable bladder is deflated, and the garment may be worn in the same manner as any other garment. When converted to the flotation configuration, the inflatable bladder may be inflated to provide flotation for the user. In a preferred embodiment, the bladder may be inflated using either a gas cartridge or an oral inflation tube. The garment portion comprises two leg portions designed to at least partially cover the user's legs when the garment is worn in the garment configuration, and the inflatable bladder comprises two opposing bladder portions, each of which is disposed at least partially within a respective one of the leg portions. Each of the bladder portions has a loop attached to a lower end of the bladder portion for harnessing the flotation device to the user's upper body when the garment is converted into the flotation configuration.

The garment further comprises a first strap and a second strap each attached to the garment. The straps have a fastener member attached to each respective strap so that the straps may be removably attached to each other. In a preferred embodiment, the fastener members are two corresponding components of a side release buckle. The first and second straps are configured to loop around the user's waist to removably attach the first and second fastener members to each other on a front side of the garment when the garment is worn in the garment configuration. Thus, in the garment configuration, the straps may function as a belt that aids in securing a lower body garment around a user's waist. The first and second straps are further configured to harness the flotation device to the user's upper body when the garment is converted into the flotation configuration. To harness the flotation device to the user's upper body, the flotation device may be placed around a user's neck so that the two opposing bladder portions are generally positioned over opposing sides of the user's chest. The straps may then be looped around the user's upper body, and each strap may be placed through one of the loops attached to the bladder portions. The straps may then be attached to each other and tightened to securely harness the flotation device to the user's upper body.

The garment portion may further comprise a plurality of belt loops disposed around the user's waist when the garment is worn in the garment configuration. The two straps may be placed through the belt loops to retain the belt in place on the garment portion and to help secure the garment to the user's waist when the garment is worn in the garment configuration. In a preferred embodiment, one end of each of the belt loops is removably attached to the garment portion, preferably utilizing hook and loop fasteners. When converting the garment from the garment configuration into the flotation configuration, the end of each belt loop that is attached to the garment portion may be detached from the garment portion to release the straps from the belt loops to allow the user to quickly convert the garment from the garment configuration into the flotation configuration when needed.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

Figure 1:
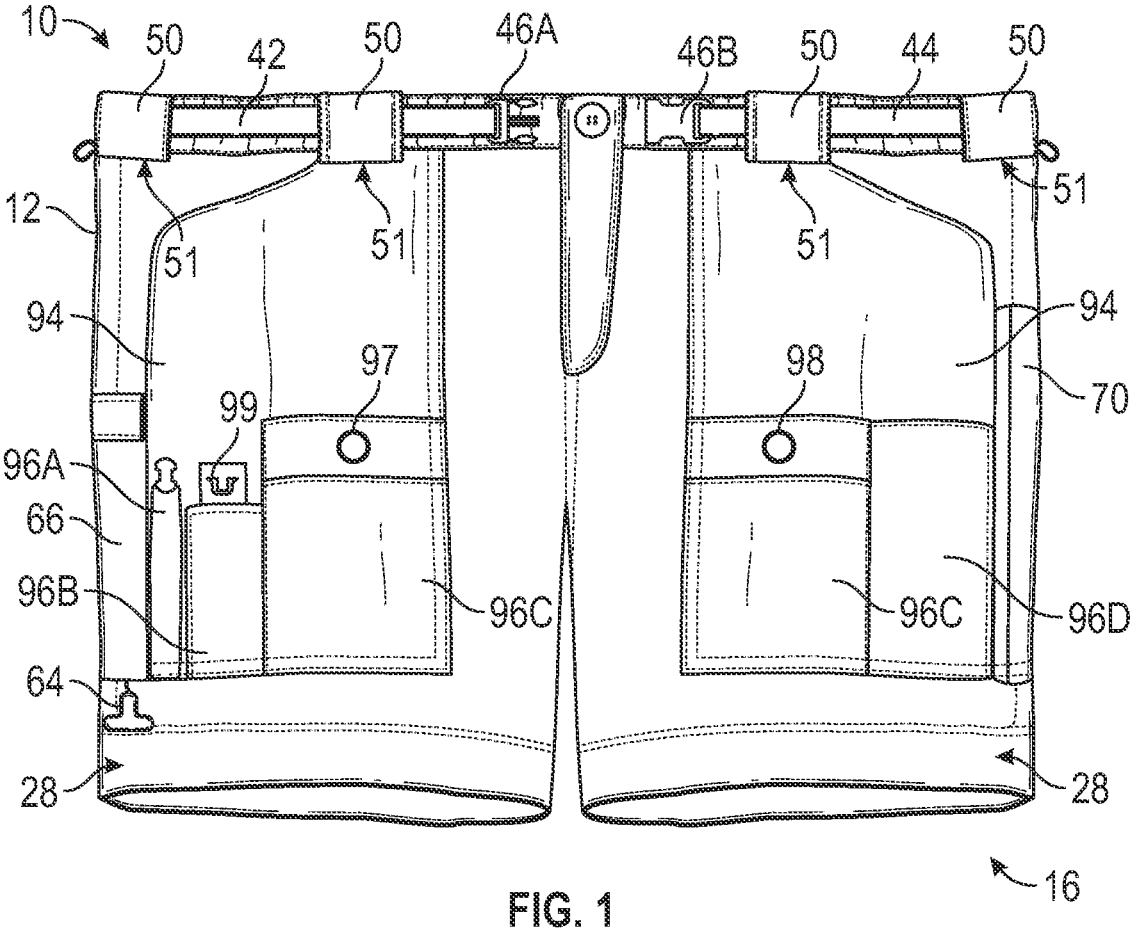
FIG. 1 shows a front view of a garment with an inflatable flotation device installed within the garment in accordance with the present disclosure.
Figure 2:
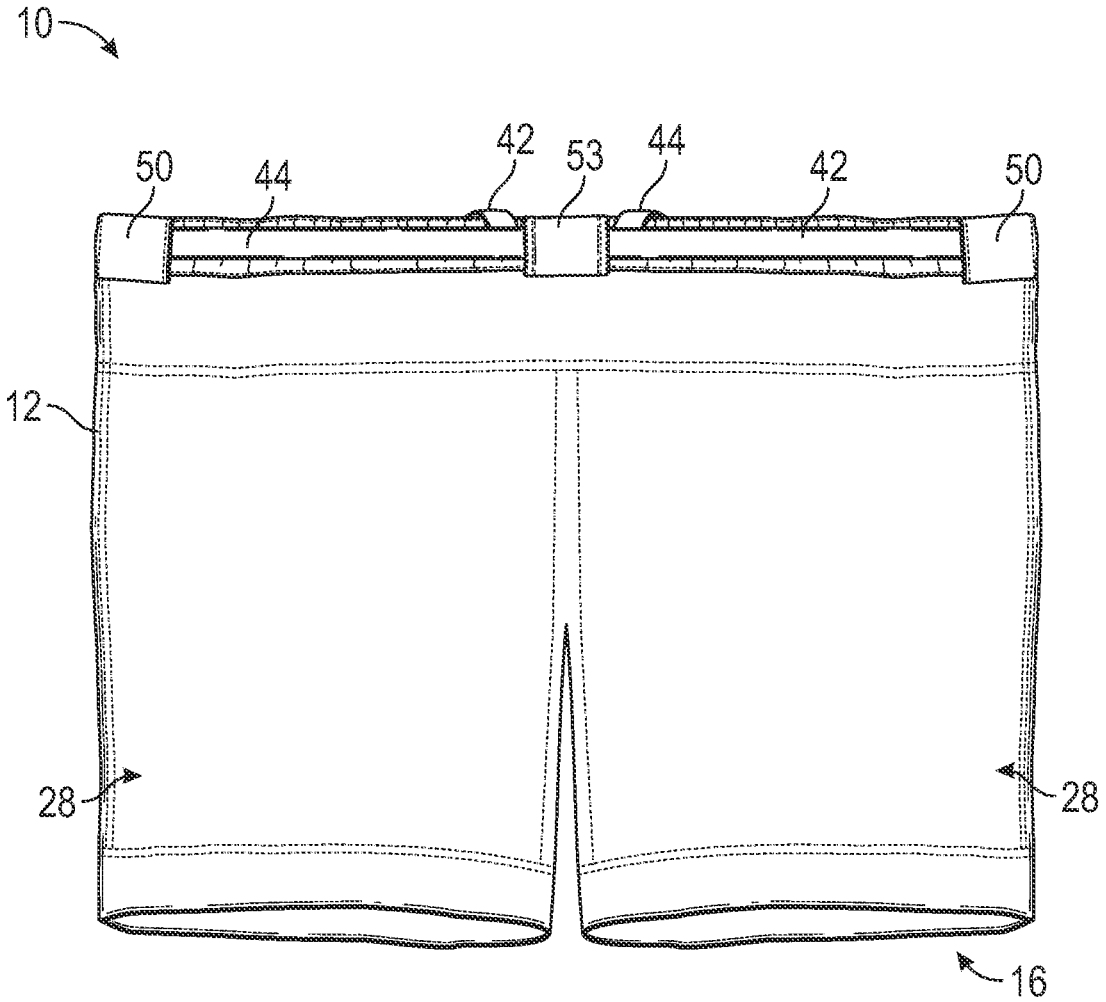
FIG. 2 shows a rear view of a garment with an inflatable flotation device installed within the garment in accordance with the present disclosure.
Figure 5:
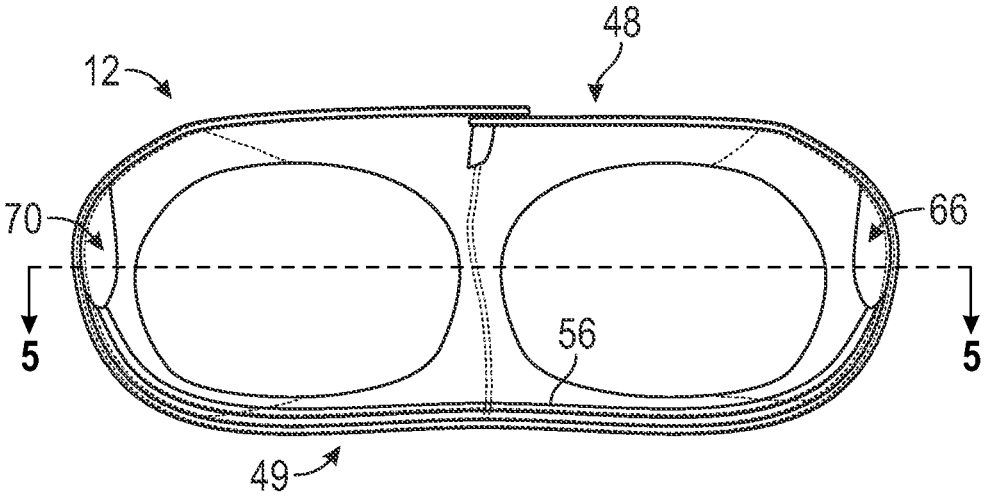
FIG. 5 shows a top plan view of a garment that may be used with an inflatable flotation device in accordance with the present disclosure.
Figure 6:
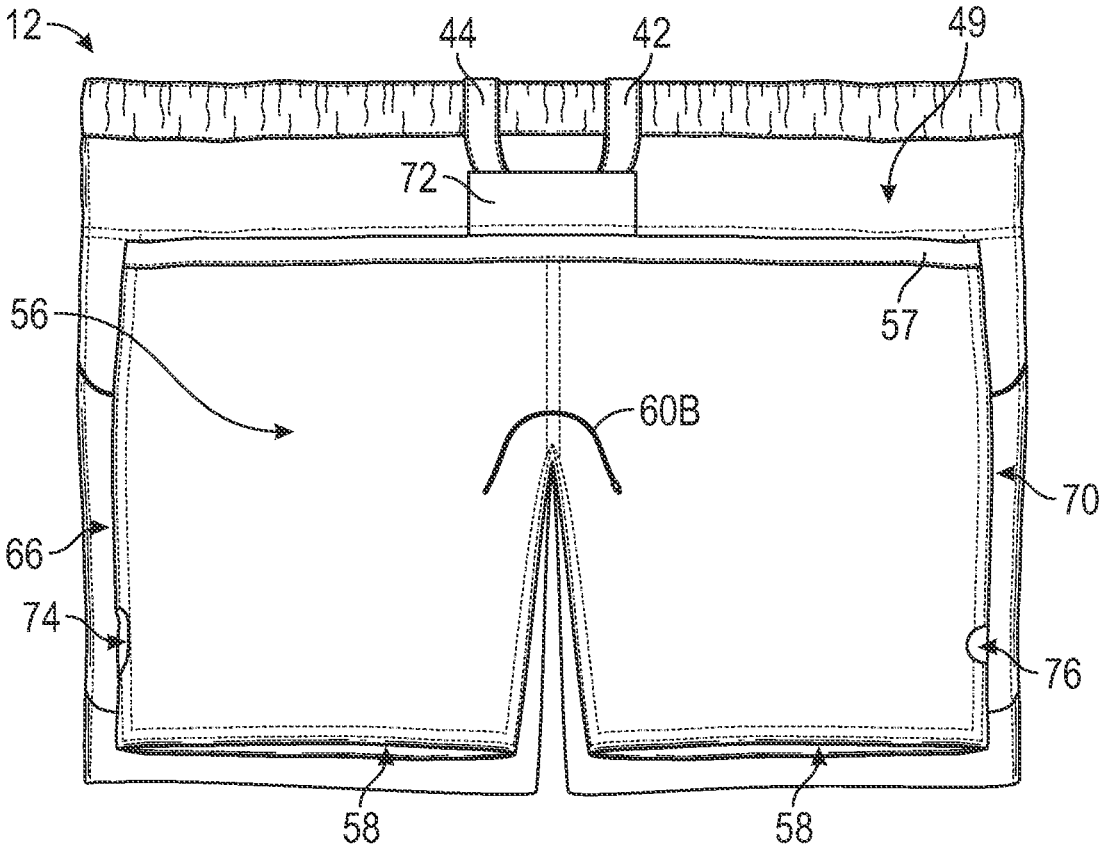
FIG. 6 shows a cross-sectional view of a garment in accordance with the present disclosure as viewed along line 5-5.
Figure 7:
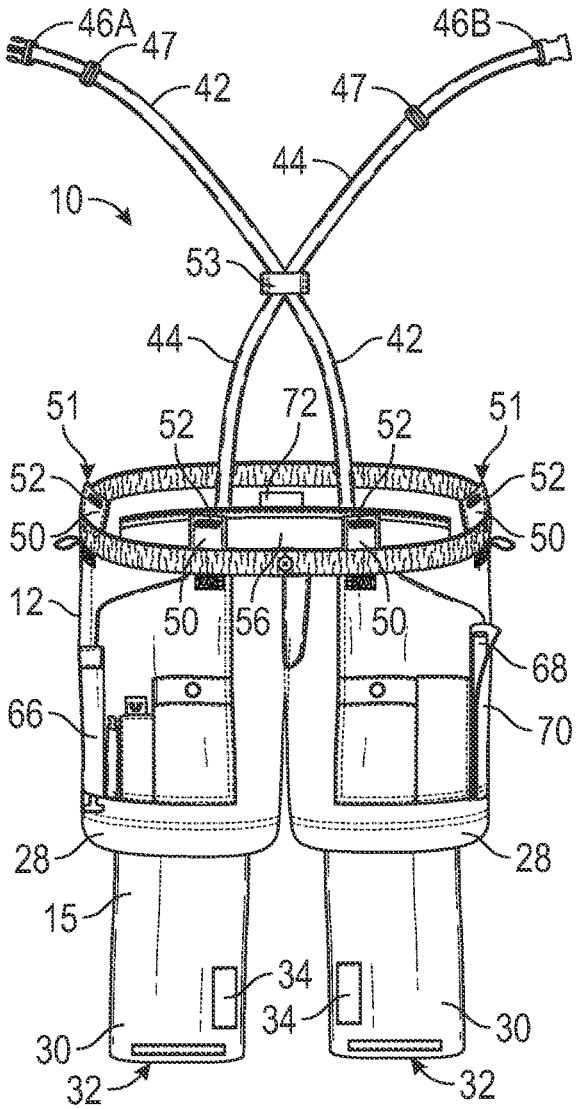
FIG. 7 shows a front perspective view of a garment with an inflatable flotation device being deployed in accordance with the present disclosure.
Figure 8:
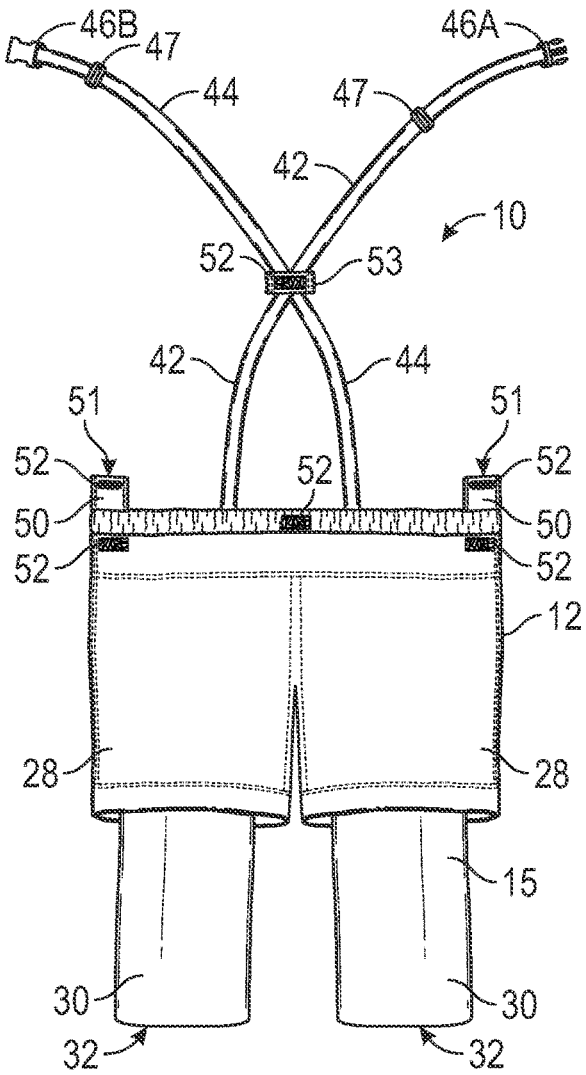
FIG. 8 shows a rear view of a garment with an inflatable flotation device being deployed in accordance with the present disclosure.
Figure 10:
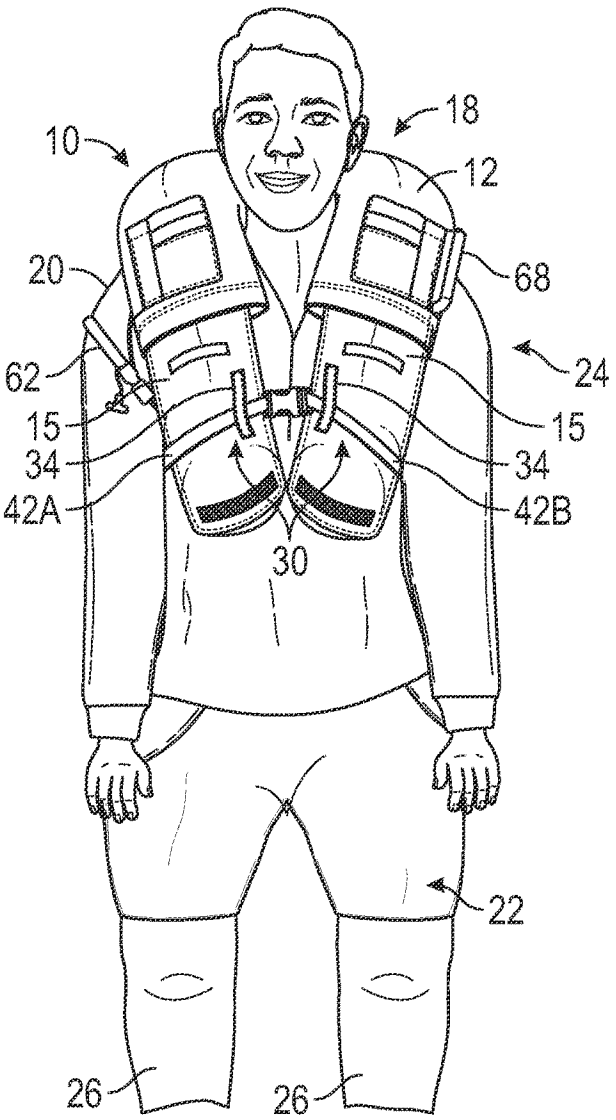
FIG. 10 shows a front view of a user with an inflatable flotation device harnessed to the user's upper body after inflation in accordance with the present disclosure.
Figure 9:
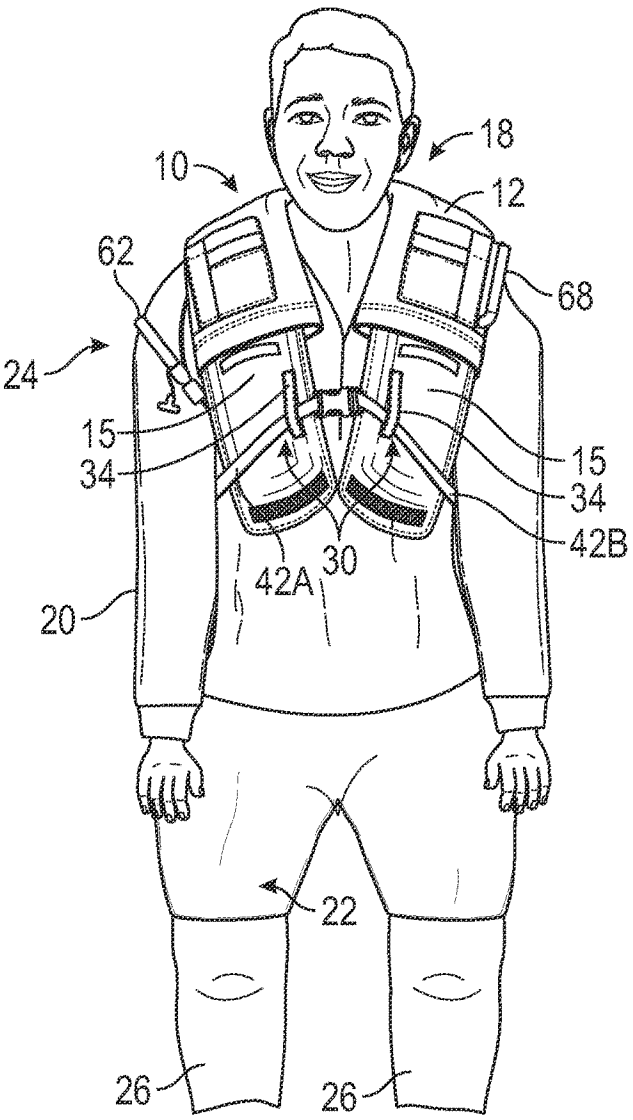
FIG. 9 shows a front view of a user with an inflatable flotation device harnessed to the user's upper body before inflation in accordance with the present disclosure.

In one aspect, a garment 10 having an integrated inflatable flotation device 14 and a method of using the garment 10 to provide flotation are provided. FIGS. 1-10 illustrate a preferred embodiment of the garment 10 or components thereof. The garment 10 comprises a wearable garment portion 12 and a flotation device 14 attached to the garment portion 12. The flotation device 14 comprises and inflatable bladder 15. The garment 10 is configured to convert between a garment configuration 16 in which the garment 10 is worn on a user's 20 lower body 22 and a flotation configuration 18 in which the flotation device 14 is harnessed to the user's 20 upper body 24. FIGS. 1 and 2 show the garment 10 in the garment configuration 16 in which a user 20 may don the lower body garment 10, which in this case is a pair of shorts. FIG. 1 shows a front side 48 of the shorts, and FIG. 2 shows a rear side 49 of the shorts. FIGS. 9 and 10 show the garment 10 in the flotation configuration 18. FIGS. 7 and 8 show the garment 10 in a state of being converted between the garment configuration 16 and the flotation configuration 18. When in the garment configuration 16, the inflatable bladder 15 is deflated, and the garment 10 may be worn in the same manner as any other garment. When converted to the flotation configuration 18, the inflatable bladder 15 may be inflated to provide flotation for the user 20. In a preferred embodiment, the bladder 15 may be inflated using either a gas cartridge 62 or an oral inflation tube 68. If a user 20 should fall into the water while wearing the garment 10, the user 20 may quickly remove the garment 10 from the user's lower body 22, convert the garment 10 into the flotation configuration 18, and then inflate the bladder 15 so that the user 20 will float in the water to prevent drowning.

The garment portion 12 comprises two leg portions 28 designed to at least partially cover the user's 20 legs 26 when the garment 10 is worn in the garment configuration 16. The inflatable bladder 15 comprises two opposing bladder portions 30, each of which is disposed at least partially within a respective one of the leg portions 28 when the garment 10 is in the garment configuration 16. Each of the bladder portions 30 has a loop 34 attached to a lower end 32 of the bladder portion 30 for harnessing the flotation device 14 to the user's upper body 24 when the garment 10 is converted into the flotation configuration 18, as shown in FIGS. 9 and 10.

The garment 10 further comprises a first strap 42 and a second strap 44 each attached to the garment 10. The first strap 42 and second strap 44 each have a fastener member 46 attached to the strap, which is preferably at a terminal end of each strap 42, 44, as best seen in FIGS. 1, 7, and 8. The fastener members 46 are designed to removably attach to each other so that straps 42 and 44 may be removably attached to each other in order to harness the flotation device 14 to the user's upper body 24, as best seen in FIGS. 9 and 10. In a preferred embodiment, the fastener members 46 are two corresponding components of a side release buckle 46. In this embodiment, the first fastener member may comprise a male member 46A of the buckle 46, and the second fastener member may comprise a female member 46B of the buckle 46. The male 46A and female 46B members are configured to interlock with each other to removably secure the two members 46A, 46B together. In alternative embodiments, the fastener members 46A and 46B may comprise other types of fastening elements, including, but not limited to, clips, snap fasteners, hook and loop fasteners, latches, bolt snaps, hook-and-eye closures, carabiners, other types of buckles or clasps, or any other types of fasteners suitable for quickly attaching straps to each other and detaching straps from each other. In a preferred embodiment, as best seen in FIGS. 9 and 10, each strap 42, 44 may include a buckle slide 47, such as a tri-glide slide, configured to adjust the length of the straps 42, 44 to ensure a tight fit in either the garment configuration 16 or the flotation configuration 18.

The first and second straps 42, 44 are configured to loop around the user's 20 waist to removably attach the first and second fastener members 46 to each other on the front side 48 of the garment 10 when the garment is worn in the garment configuration 16. Thus, as best seen in FIG. 1, when in the garment configuration 16, the straps 42, 44 may function as a belt that aids in securing a lower body garment 10 around a user's 20 waist. The first and second straps 42, 44 are further configured to harness the flotation device 14 to the user's upper body 22 when the garment 10 is converted into the flotation configuration 18. To harness the flotation device 14 to the user's upper body 22, the flotation device 14 may be placed around a user's neck so that the two opposing bladder portions 30 of the inflatable bladder 15 are generally positioned over opposing sides of the user's 20 chest, as shown in FIGS. 9 and 10. The straps 42, 44 may then be looped around the user's upper body 22, and each strap 42, 44 may be placed through one of the loops 34 attached to the bladder portions 30. The straps 42, 44 may then be attached to each other using the buckle 46 and then, if necessary, tightened using the buckle slide 47 to securely harness the flotation device 14 to the user's upper body 22.

Figure 15:
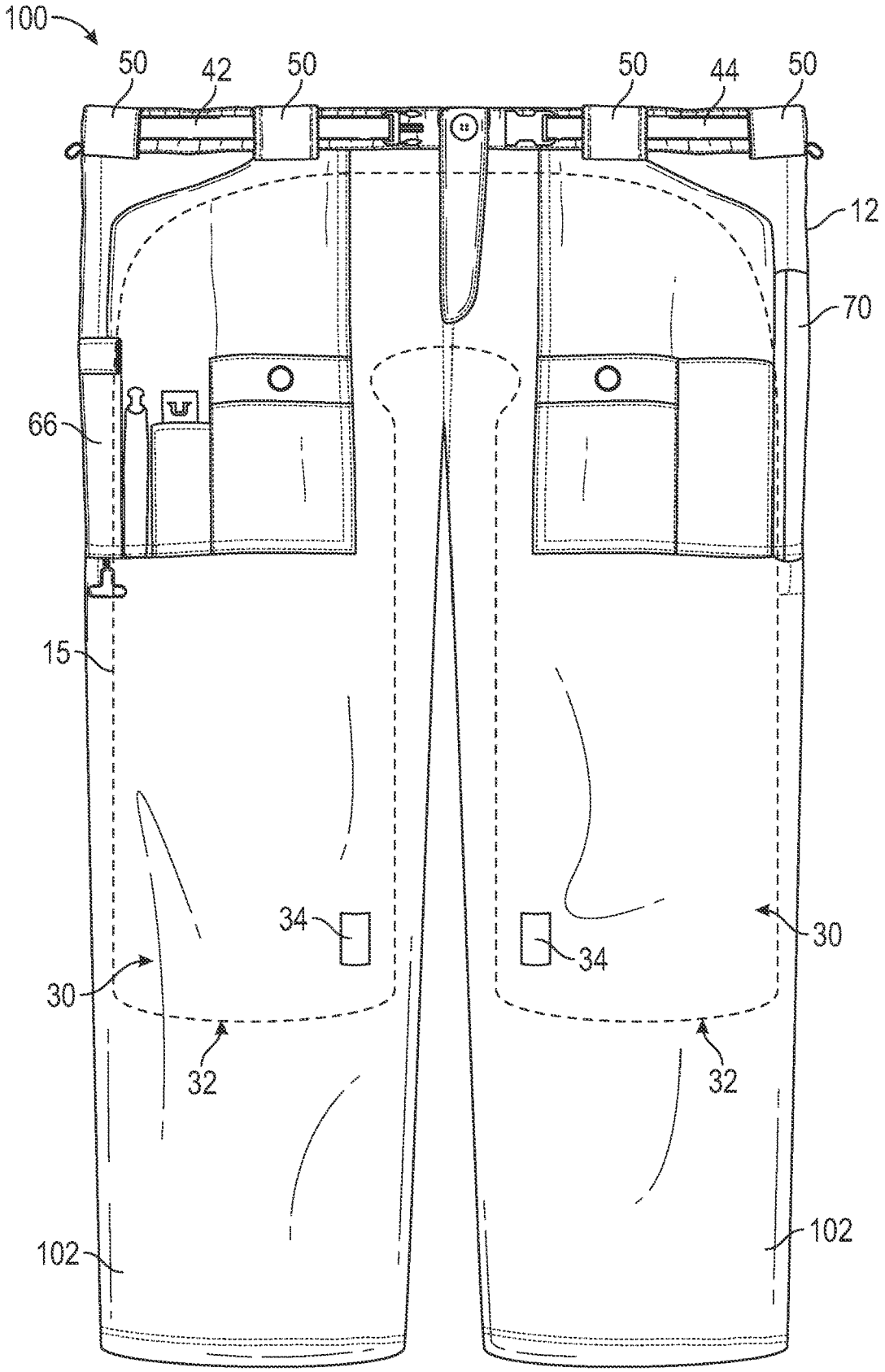
FIG. 15 shows a front view of trousers with an inflatable flotation device installed within the trousers in accordance with the present disclosure.

In a preferred embodiment, as best seen in FIGS. 1 and 2, the garment 10 is preferably a pair of shorts that covers only an upper portion of the user's legs 26 and leaves significant portions of the user's legs 26 exposed. In an alternative embodiment, as shown in FIG. 15, the garment may comprise a pair of trousers that covers most of the user's legs 26 and extends down to an area around the user's ankles. In other alternative embodiments, the garment may have leg portions 28 of varying lengths between shorts and trousers. In a preferred embodiment, as best seen in FIGS. 1 and 2, the inflatable bladder 15 is entirely contained within the garment portion 12 of the garment 10 when the garment 10 is in the garment configuration 16 so that the inflatable bladder 15 is not visible from an exterior of the garment 10. To completely contain the bladder 15 within a lower body garment 10 such as a pair of shorts, which have generally short legs portions 28, the opposing bladder portions 30 of the flotation device 14 may be configured to convert between a shortened configuration 40 and a lengthened configuration 41. When in the shortened configuration 40, the opposing bladder portions 30 of the inflatable bladder 15 may be shortened from a fully extended length so that the entire bladder 15 may fit entirely within the garment portion 12 of the garment 10, as shown in FIGS. 1 and 2. When in the lengthened configuration 41, the bladder portions 30 may extend to the fully extended length, which provides sufficient coverage of the user's chest in order to provide adequate flotation. In an alternative embodiment, the inflatable bladder 15 may be disposed on and attached to an exterior of the garment portion 12.

Figure 3:
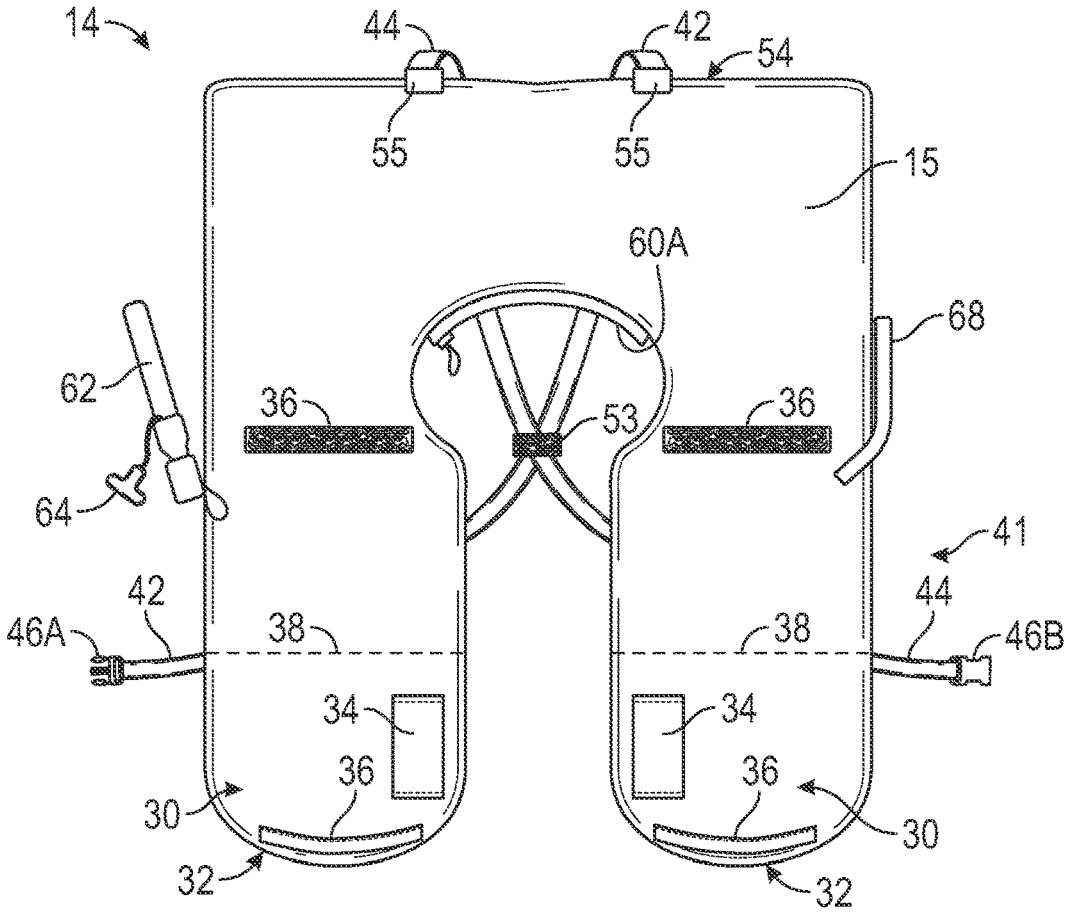
FIG. 3 shows a front view of an inflatable flotation device that may be used with a garment in accordance with the present disclosure.
Figure 4:
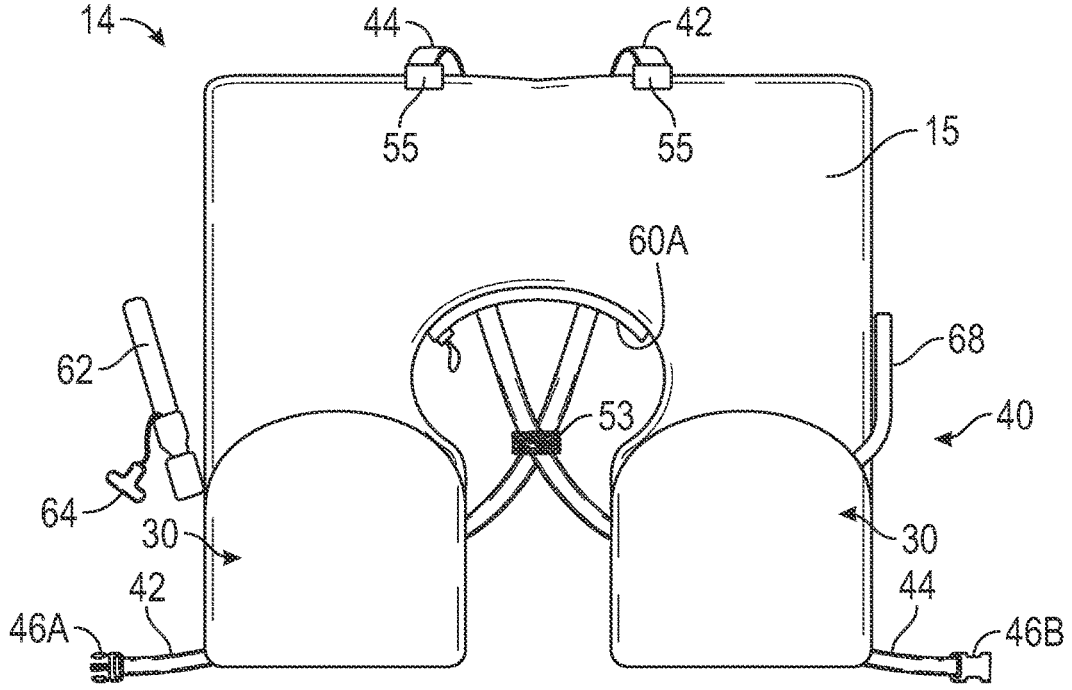
FIG. 4 shows a folded configuration of the inflatable flotation device shown in FIG. 3 in accordance with the present disclosure.

FIGS. 3 and 4 show the flotation device 14 detached from the garment portion 12. The flotation device 14 is preferably removably attached to the garment portion 12 during use of the garment 10 so that the garment portion 12 may be laundered or worn separately from the flotation device 14. FIG. 3 shows the bladder portions 30 of the flotation device 14 in the lengthened configuration 41, and FIG. 4 shows the bladder portions 30 in the shortened configuration 40. In a preferred embodiment, as best seen in FIG. 3, each bladder portion 30 comprises a hook and loop fastener 36 configured to removably secure the bladder portion 30 in the shortened configuration 40. The hook and loop fastener 36 may comprise two corresponding strips of fastener material secured to each bladder portion 30 for securing one part of each bladder portion 30 to another part of the same bladder portion 30. In this embodiment, each bladder portion 30 may be folded along a fold line 38 and fastened to itself to shorten the length of the bladder portion 30. Thus, in this embodiment, the shortened configuration 40 is a folded configuration, as shown in FIG. 4, which allows the bladder portions 30 to fit within each of the leg portions 28 of the garment portion 12 when the garment 10 is in the garment configuration 16. Each bladder portion 30 may be fully extended to the lengthened configuration 41 by unfolding each bladder portion 30 after separating the strips of fastener material of each hook and loop fastener 36 attached to each bladder portion 30.

Figure 13:
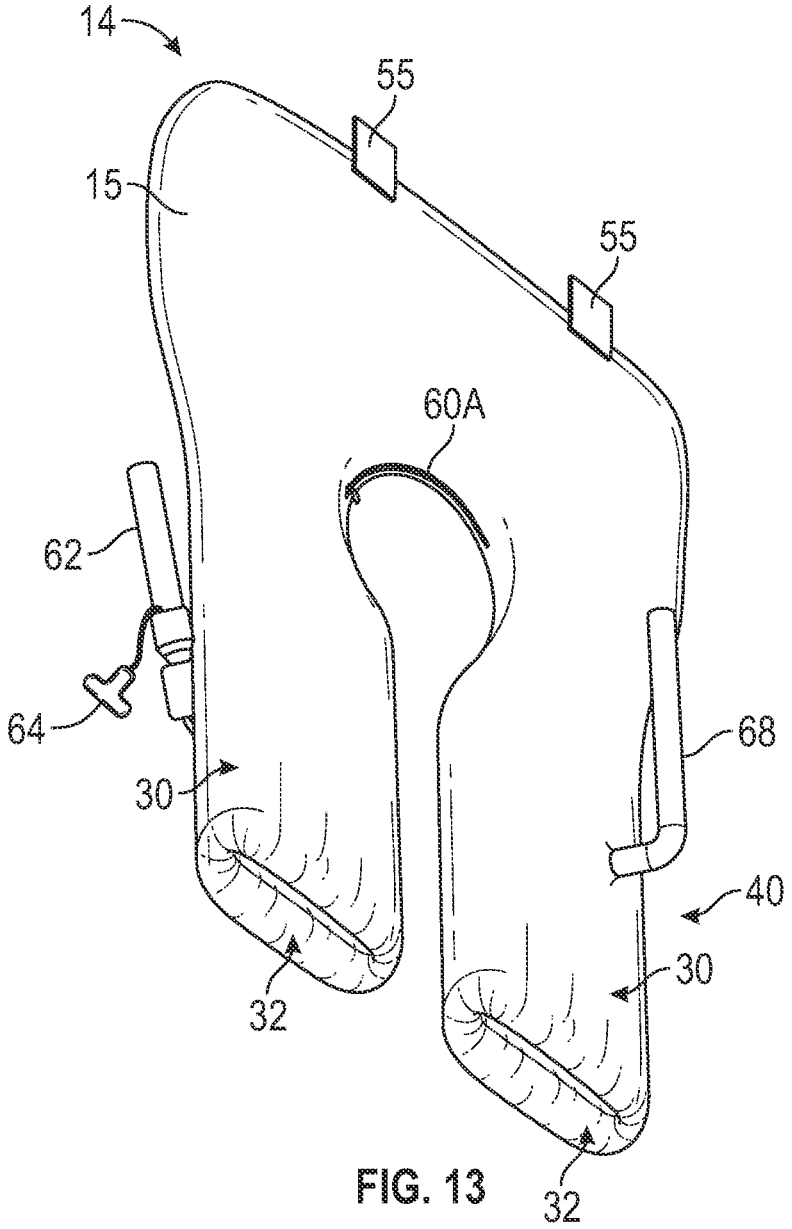
FIG. 13 shows a perspective view of an alternative embodiment of an inflatable flotation device that may be used with a garment in accordance with the present disclosure.
Figure 14:
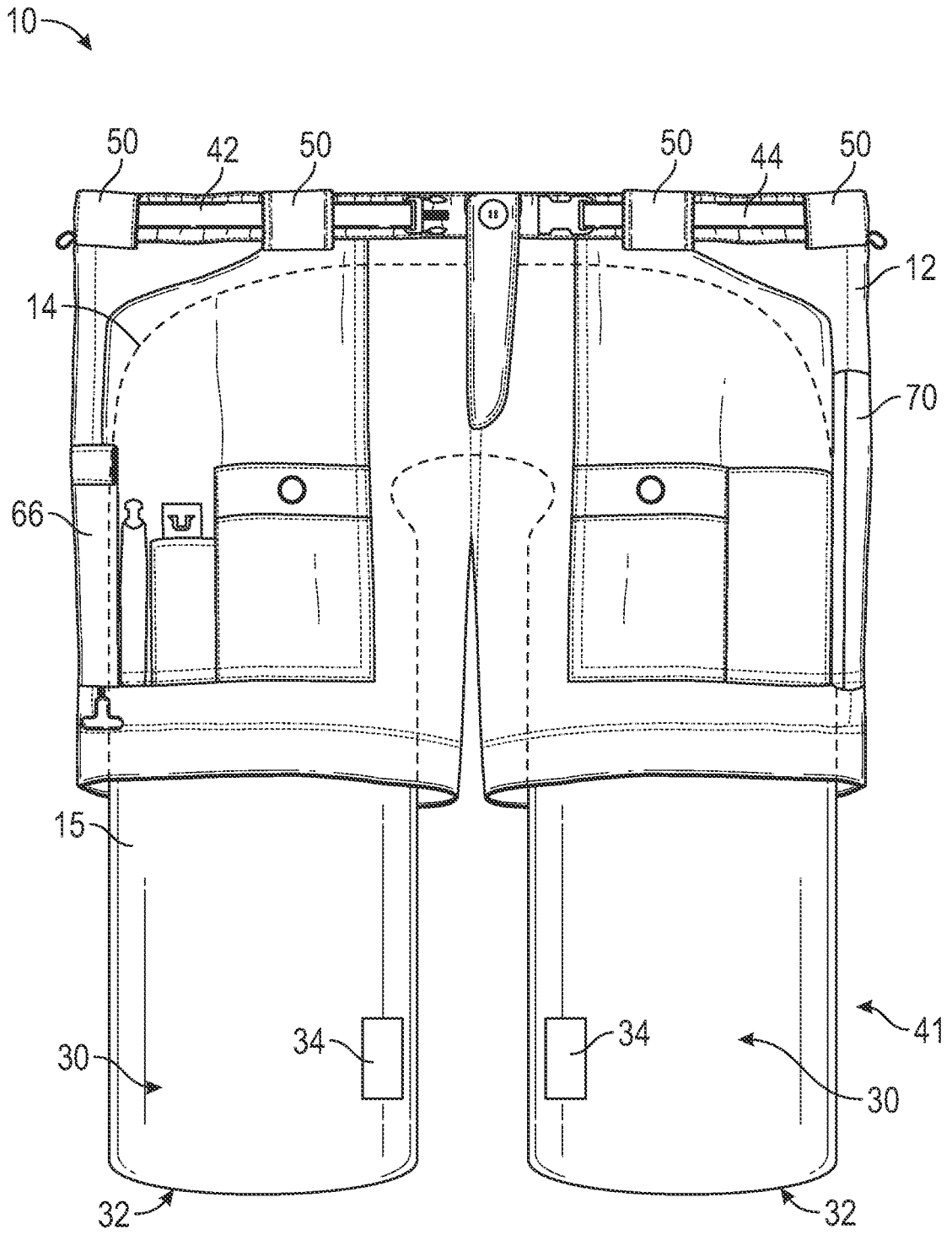
FIG. 14 shows an extended configuration of the inflatable flotation device shown in FIG. 13 integrated with a garment in accordance with the present disclosure.

In an alternative embodiment, as shown in FIG. 13, the lower end 32 of each respective one of the bladder portions 30 of the inflatable bladder 15 may be internally retracted into itself when the bladder 15 is in the shortened configuration 40. In this embodiment, the bladder 15 is deflated when in the shortened configuration 40 in order to fit within the leg portions 28 of a pair of shorts, and the lower end 32 of each respective one of the bladder portions 30 is configured to automatically extend to the lengthened configuration 41 upon inflation of the bladder 15, as shown in FIG. 14. Thus, as the user 20 inflates the bladder 15, preferably using either the gas cartridge 62 or the oral inflation tube 68, the two opposing bladder portions 30 will automatically convert from the shorted configuration 40 to the lengthened configuration 41 as gas enters the bladder 15 while the bladder 15 is being inflated, which forces the bladder portions 30 to automatically extend. The bladder portions 15 will automatically extend through the open bottoms of the leg portions 28 to the lengthened configuration 41, as shown in FIG. 14. Once fully extended, loops 34 will be in position for the user 20 to harness the flotation device 14 to the user's upper body 24.

In a preferred embodiment, as best seen in FIGS. 1-2 and 7-8, the garment portion 12 further comprises a plurality of belt loops 50, which are disposed around the user's waist when the garment 10 is worn in the garment configuration 16. As shown in FIGS. 1 and 2, the two straps 42, 44 may be placed through the belt loops 50 to retain the straps 42, 44 in place on the garment portion 12 and to help secure the garment 10 to the user's 20 waist so that the straps 42, 44 may function as a garment belt when the garment 10 is worn in the garment configuration 16. In a preferred embodiment, as best seen in FIGS. 7 and 8, a first end 51 of each of the belt loops 50 may be removably attached to the garment portion 12. An opposing second end of each belt loop 50 is preferably integrally attached to the garment portion 12 by being sewn to the garment portion 12. In a preferred embodiment, the first end 51 of each belt loop 50 may be attached to and detached from the garment portion 12 utilizing hook and loop fasteners 52, which may each comprise one piece of fastener material attached to each belt loop 50 and a second corresponding piece of fastener material attached to an exterior of the garment portion 12. When converting the garment 10 from the garment configuration 16 into the flotation configuration 18, the end 51 of each belt loop 50 that is attached to the garment portion 12 may be detached from the garment portion 12 to release the straps 42, 44 from the belt loops 50 to allow the user 20 to quickly convert the garment 10 from the garment configuration 16 into the flotation configuration 18. FIGS. 7 and 8 show the first end 51 of each belt loop 50 detached from the garment portion 12 to show the garment 10 being converted from the garment configuration 16 into the flotation configuration 18.

The first and second straps 42, 44 may be attached to an upper end of the garment 10. In a preferred embodiment, as best seen in FIG. 3, the straps 42, 44 are attached to an upper end 54 of the flotation device 14 at two attachment points 55. The straps 42, 44 are preferably removably attached to the flotation device 14 at attachment points 55, which may comprise any type of fastener suitable for removable attachment of the straps 42, 44 to the bladder 15, so that the straps 42, 44 may be detached and used as a garment belt even if the garment 10 is being worn without the flotation device 14. For instance, attachment points 55 may preferably comprise buckles, clasps, carabiners, bolt snaps, or any other type of fastener that provides a secure attachment that does not allow detachment by pulling components apart, such as in the case of snap fasteners or hook and loop fasteners, so that the straps 42, 44 will remain attached to the bladder 15 and will not become inadvertently detached during use of the garment 10. Alternatively, the straps 42, 44 may be permanently attached to the bladder 15 at attachment points 55. The loop 34 attached to the lower end 32 of each bladder portion 30 is sized to receive one of the first and second straps 42, 44 therethrough so that one of the straps 42, 44 may be inserted through each one of the loops 34 when using the straps to securely harness the flotation device 14 to the user's upper body 24, as shown in FIGS. 9 and 10.

In a preferred embodiment, the garment portion 12 further comprises an internal pocket 56 sized and shaped to receive at least a portion of the inflatable bladder 15 therein. FIG. 5 shows a top view of the garment portion 12 without the flotation device 14 attached, and FIG. 6 shows a cross section of the garment portion 12 showing an interior of the rear side 49 of the garment portion 12. The internal pocket 56 may have two opposing lower open ends 58 that generally correspond to the leg portions 28 of the garment portion 12. When the garment 10 is in the garment configuration 16, the inflatable bladder 15 is preferably in the shortened configuration 40 and fits entirely within the internal pocket 56. When the garment 10 is in the flotation configuration 18, each bladder portion 30 is extendable through a respective one of the lower open ends 58 of the internal pocket 56 so that the flotation device 14 may be converted into the lengthened configuration 41 to provide flotation.

The internal pocket 56 is open at an upper end for installation of the inflatable bladder 15 therein. The internal pocket 56 may preferably include a closure flap 57 at the upper end of the pocket 56 for closing, or at least partially closing, the pocket 56. The closure flap 57 is preferably closable with hook and loop fasteners attached to an interior of the flap 57 and an exterior of the pocket 56. To further help to securely attach the flotation device 14 to the garment portion 12, in a preferred embodiment, the garment further comprises an internal zipper 60 that is configured to removably attach the flotation device 14 to the garment portion 12. The zipper 60 comprises a first zipper element 60A attached to an interior of the garment portion 14, as shown in FIG. 6, and a second zipper element 60B attached to the inflatable bladder 15, as best seen in FIGS. 3 and 4. In a preferred embodiment, the second zipper element 60B shown in FIG. 6 is attached to an interior of the internal pocket 56 so that the zipper 60 may be used to secure the bladder 15 within the internal pocket 56. The second zipper element 60B is configured to interlock with the first zipper element 60A to attach the flotation device 14 to the garment portion 12.

In a preferred embodiment, the garment 10 further comprises a false belt loop 53 that, unlike the other belt loops 50, may be detached entirely from the waist area of the garment portion 12, as best seen in FIGS. 7 and 8. The false belt loop 53 is preferably attachable and detachable by hook and loop fasteners, which may include fastening material 52 on an interior side of the false belt loop 53 and on the garment portion 12, as best seen in FIG. 8. In a preferred embodiment, as shown in FIG. 2, the false belt loop 53 is preferably attached to the rear side 49 of the garment portion 12 in a generally centered position of the garment. As shown in FIGS. 3-4 and 7-8, the false belt loop 53 may be attached to both straps 42 and 44 so that a portion of each strap 42, 44 extends from the flotation device 14 to the false belt loop 53 and from the false belt loop 53 to each of the fastener members 46A and 46B. The false belt loop 53 is preferably integrally attached to each of the straps 42, 44 by being sewn to the straps 42, 44. Thus, when the garment 10 is worn in the garment configuration 16, the false belt loop 53 may be attached to the garment portion 12 so that a length of each strap 42, 44 may extend around a user's 20 waist to be used as a garment belt. When the garment 10 is worn in the flotation configuration 18, the false belt loop 53 may be detached directly from the garment portion 12 to provide additional length to each strap 42, 44 to include the portions of each strap 42, 44 between the flotation device 14 and the false belt loop 53. This additional length may allow the straps 42, 44 to extend around the user's upper body 24 to harness the flotation device 14 to the user's upper body 24 when in the flotation configuration 18, which generally requires greater length than extending the straps 42, 44 around only the user's 20 waist.

When the garment 10 is worn in the garment configuration 16, the excess length of straps 42 and 44 between the flotation device 14 and the false belt loop 53 may be stored in a separate pocket 72, which is preferably located within an interior of the garment portion 12 above the internal pocket 56 that holds the inflatable bladder 15, as best seen in FIG. 6. When the bladder 15 is stored inside pocket 56 in the garment configuration 16, the straps 42, 44 may extend from the bladder 15 out of the upper end of pocket 56 with the false belt loop 53 attached directly to the garment portion 12 and the excess length of the straps 42, 44 stored within pocket 72. FIG. 6 shows the garment 10 with the straps 42, 44 detached from the flotation device 14 and the terminal end of the straps 42, 44 opposite buckle 46 being stored within pocket 72.

The flotation device 14 further comprises a mechanism for inflating the bladder 15 to provide flotation. In a preferred embodiment, the flotation device 14 may comprise a gas cartridge 62, which is preferably a carbon dioxide ($CO_2$) cartridge. The cartridge 62 is configured to inflate the bladder 15 upon activation by the user 20. The cartridge 62 may be activated by pulling an activation cord 64 to release compressed gas from the pressurized cartridge 62 into the bladder 15 to immediately inflate the bladder 15. In another preferred embodiment, the flotation device 14 may comprise an oral inflation tube 68, which is configured to allow the user 20 to inflate the bladder 15 manually by exhaling into the tube 68. The inflation tube 68 may include an internal one-way valve to allow gas to enter the bladder 15 but not to flow out of the bladder 15 so that pressure may be maintained once the bladder 15 is inflated. In another preferred embodiment, as best seen in FIG. 3, the flotation device 14 may comprise both a gas cartridge 62 and an oral inflation tube 68 so that the user 20 has the option to manually inflate the bladder 15 should the gas cartridge 62 fail.

The gas cartridge 62 and the inflation tube 68 are preferably disposed on opposite sides of the garment 10. In a preferred embodiment, the gas cartridge 62 is disposed within an exterior pocket 66 of the garment portion 12 on one side of the garment 10, and the inflation tube 68 is disposed within another exterior pocket 70 of the garment portion 12 on the opposite side of the garment 10. Both pockets 66 and 70 are accessible from the exterior of the garment 10. This allows the user 20 to have quick access to both the gas cartridge 62 and the inflation tube 68 through the exterior pockets 66, 70 of the garment portion 12, as best seen in FIG. 9, when the flotation device 14 is harnessed to the user's upper body 24 in the flotation configuration 18. To provide access between the bladder 15 stored within pocket 56 and both the gas cartridge 62 and inflation tube 68, the garment portion 12 may include an opening 74 between internal pocket 56 and exterior pocket 66, as shown in FIG. 6, to connect the gas cartridge 62 to the bladder 15. Similarly, the garment portion 12 may include an opening 76 between internal pocket 56 and exterior pocket 70 for the inflation tube 68. When installing the flotation device 14 within the garment portion 12, the bladder 15 may be placed within pocket 56 and the inflation tube 68 may be inserted into exterior pocket 70 through opening 76. Similarly, gas cartridge 62 may be placed within exterior pocket 66 and connected to the bladder 15 through opening 74. As best seen in FIG. 1, exterior pocket 66 may optionally be open at a lower end of the pocket 66 so that a handle portion 64 connected to the activation cord may extend outside of the pocket 66 for ease of access.

As best seen in FIG. 3, the inflatable bladder 15 preferably comprises a single bladder chamber so that the opposing bladder portions 30 are in fluid communication with each other through a connecting portion of the bladder 15 that extends around the back of the user's 20 neck when the garment 10 is in the flotation configuration 18. A single bladder chamber allows the entire bladder 15 to be inflated using either the gas cartridge 62 or the inflation tube 68 on either side of the garment 10. Alternatively, the bladder 15 may comprise multiple bladder chambers. In another alternative embodiment, the flotation device 14 may also include an auto-inflation device in addition to the manually operated inflation tube 68 and optional gas cartridge 62. The auto-inflation device allows the bladder 15 to self-inflate if the user 20 falls into the water, which is advantageous if the user 20 is unconscious. The auto-inflation device may include a hydrostatic release actuator or any other suitable type of actuator configured to inflate the bladder 15 automatically without action by the user 20 when the garment 10 is in the water.

Figure 11:
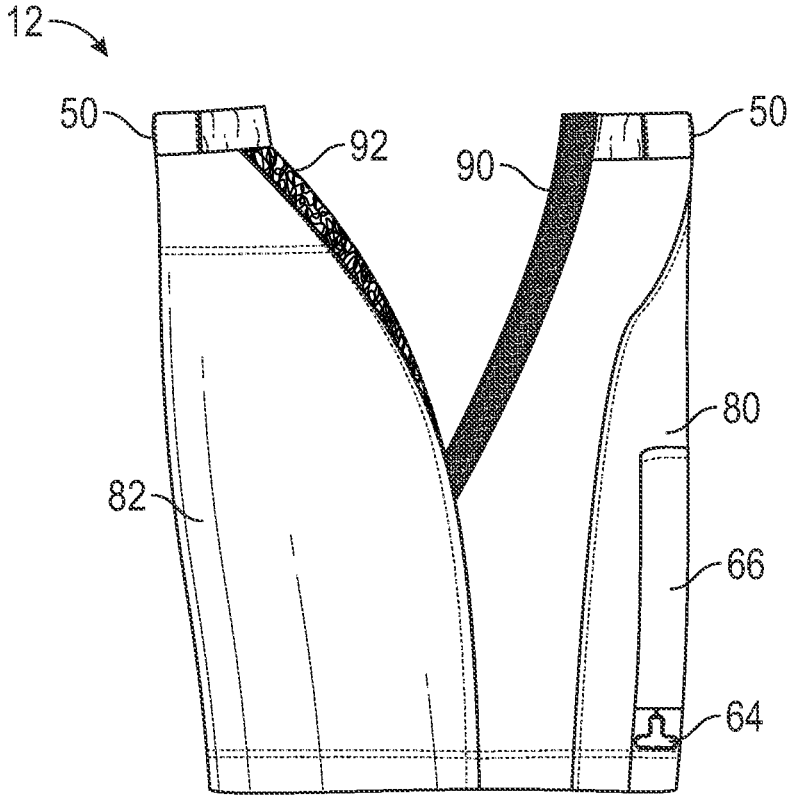
FIG. 11 shows a side view of an alternative embodiment of a garment with an inflatable flotation device in which front and rear portions of the garment are separable by fasteners disposed along side portions of the garment in accordance with the present disclosure.
Figure 12:
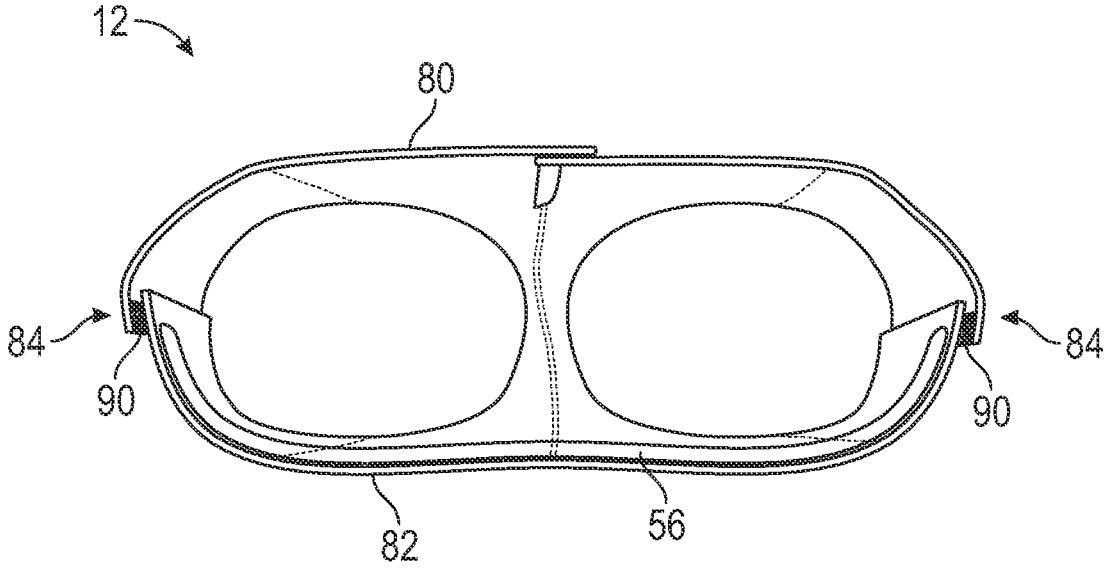
FIG. 12 shows a top plan view of the garment shown in FIG. 11 with the fasteners separated from each other.

FIGS. 11 and 12 show an alternative embodiment of the garment 10 in which the garment portion 12 comprises a front half 80 and a rear half 82 of which portions of the front half 80 and rear half 82 may be separated from each other to facilitate removal of the garment portion 12 from the user's lower body 22. As best seen in FIG. 12, the front half 80 is removably attached to the rear half 82 along two opposing sides 84 of the garment portion 12 so that the front half 80 may be completely separated from the rear half 82 along the length of both sides 84 of the garment portion 12 from an upper end to a lower end of the garment portion 12. In a preferred embodiment, the front half 80 is removably attached to the rear half 82 on a first side 84 of the garment portion 12 by a first pair of strips 90, 92 of a first hook and loop fastener, and the front half 80 is also removably attached to the rear half 82 on an opposing second side 84 of the garment portion 12 by a second pair of strips 90, 92 of a second hook and loop fastener. Thus, the front half 80 has two opposing strips 90 on each side 84 of the garment portion 12, and the second half 82 also has two opposing strips 92 on each side 84, which are compatible with each of the strips 90, respectively, on the first half 80. By allowing complete separation of the halves 80, 82 along the sides 84 of the garment portion 12, the garment 10 is designed to be removed from the user's lower body 22 by separating the first pair of strips 90, 92 of the first hook and loop fastener and the second pair of strips 90, 92 of the second hook and loop fastener, which allows the user 20 to quickly remove the garment 10 from the lower body 22 when converting the garment 10 from the garment configuration 16 into the flotation configuration 18.

FIGS. 13 and 14 show an alternative embodiment of the garment 10 in which the flotation device 12 may be automatically converted from the shortened configuration 40 of the bladder 15 into the lengthened configuration 41 of the bladder 15 by the action of the user 20 inflating the bladder 15. As shown in FIG. 13, in this embodiment the lower end 32 of each respective one of the bladder portions 30 of the inflatable bladder 15 is internally retracted into itself when the bladder 15 is in the shortened configuration 40. The lower end 32 of each bladder portion 30 is configured to automatically extend to the lengthened configuration 41, as shown in FIG. 14, upon inflation of the bladder 15. Thus, as gas enters the bladder 15, either through use of the gas cartridge 62 or inflation tube 68, the flow of gas forces the retracted portion of each bladder portion 30 to extend to the lengthened configuration 41 automatically. When in the shortened configuration 40, the loops 34 attached to the bladder portions 30 that are used for harnessing the device may also be retracted within the bladder portions 30. Thus, in one embodiment, the bladder 15 may be at least partially inflated to position the loops 34 for using the straps 42, 44 to harness the device. The bladder 15 may be fully inflated before the user 20 harnesses the device, or the user 20 may optionally partially inflate the bladder 15 using the inflation tube 68 in order to extend the bladder portions 30 to an extent sufficient to properly position the loops 34 for harnessing. Then, after harnessing the partially inflated flotation device 14 to the user's upper body 24, the user 20 may complete inflation of the device.

In an alternative embodiment, as shown in FIG. 15, the garment 100 may comprise a pair of trousers that covers most of the user's legs 26. In this embodiment, the garment 100 may comprise leg portions 102 that extend down to an area generally below the user's 20 knees and near the user's ankles. The bladder portions 30 may remain in the lengthened configuration 41 when in both the garment configuration 16 and the flotation configuration 18 because leg portions 102 will fully cover the bladder portions 30 in the lengthened configuration 41. In a preferred embodiment, the loops 34 used for harnessing the flotation device 14 to the user's upper body 24 may be attached to an exterior of leg portions 102 so that the lower ends 32 of the bladder portions 30 do not need to be exposed in order to harness the device in the flotation configuration 18. In one embodiment, as shown in FIG. 15, the loops 34 may be attached to a front side of leg portions 102. Alternatively, the loops 34 may be attached to a rear side of leg portions 102.

Figure 16:
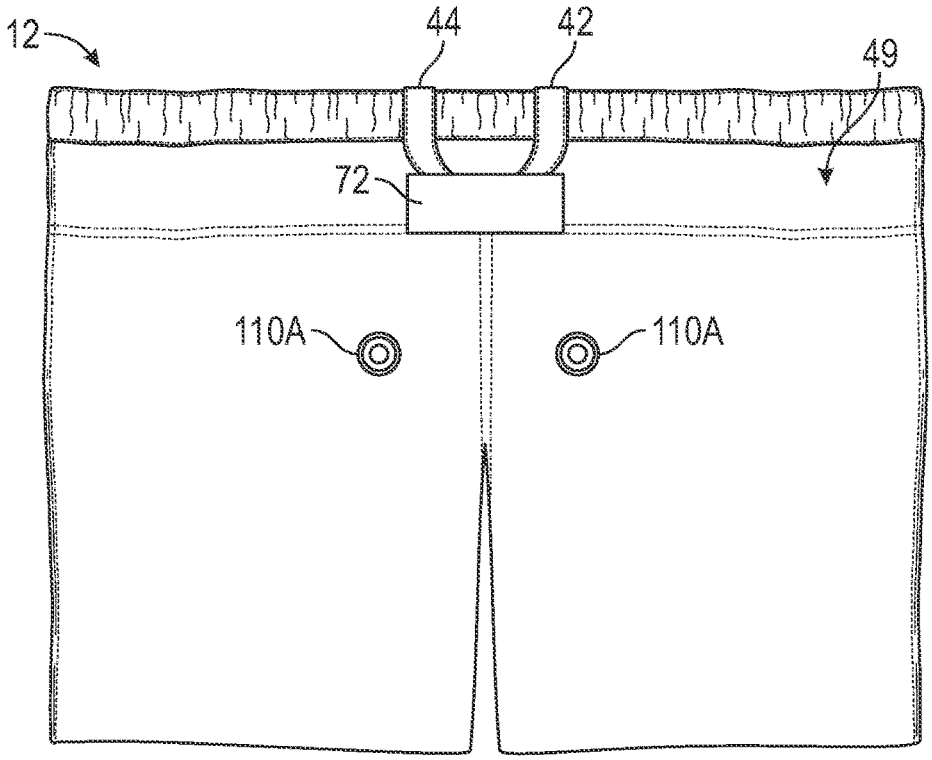
FIG. 16 shows a cross-sectional view of an alternative embodiment of a garment showing an interior of a rear portion of the garment in accordance with the present disclosure.
Figure 17:
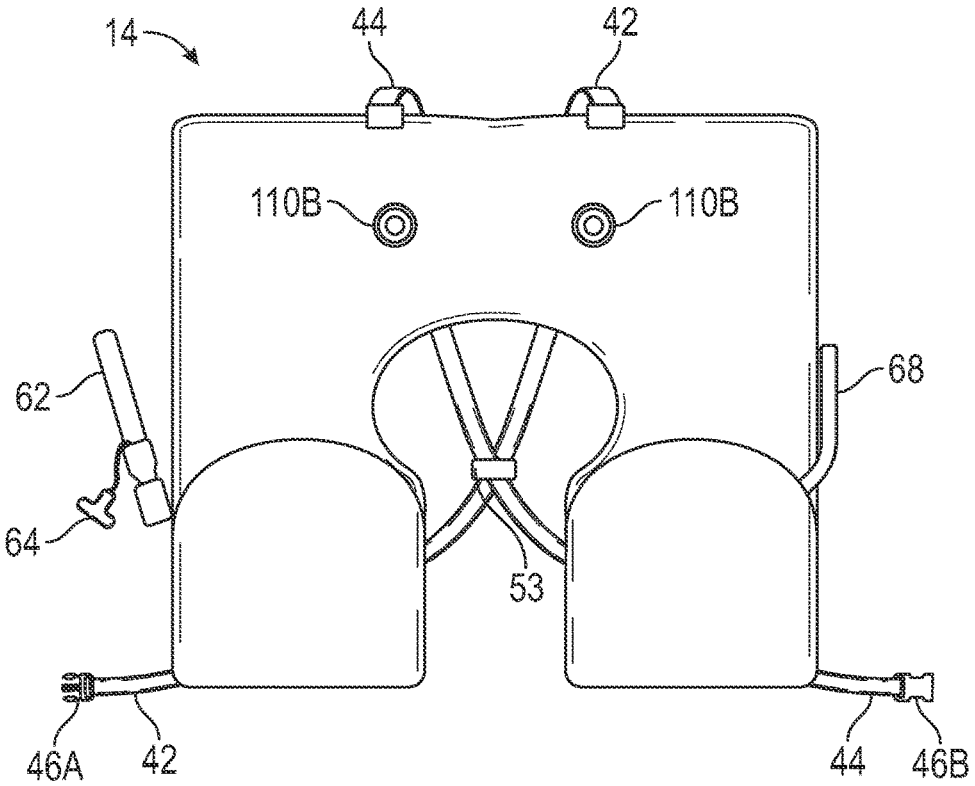
FIG. 17 shows a folded configuration of an alternative embodiment of an inflatable flotation device that is compatible with the garment shown in FIG. 16 in accordance with the present disclosure.

FIGS. 16 and 17 show an alternative embodiment of the garment 10 in which the garment portion 12 comprises a first pair of snap fastener elements 110A each attached to the garment portion 12, and the flotation device 14 comprises a second pair of snap fastener elements 110B each attached to the inflatable bladder 15. In this embodiment, the first 110A and second 110B pairs of snap fastener elements are designed to interlock in a snap fit relation to removably attach the flotation device 14 to the garment portion 12. Each of the snap fastener elements 110A and 110B are preferably integrally attached to the garment portion 12 or to the flotation device 14 by riveting. In this embodiment, the flotation device 14 may be detached from the garment portion 12 by forcibly separating snap fasteners 110A from snap fasteners 110B. In this embodiment, the gas cartridge 62 and/or the inflation tube 68 are preferably not disposed in an exterior pocket but instead are disposed within the interior of the garment portion 12 along with the inflatable bladder 15. Thus, the entire flotation device 14 may be quickly separated from the garment portion 12 by separating snap fasteners 110A from snap fasteners 110B and by removing straps 42 and 44 from the belt loops 50. The flotation device 14 may then be harnessed to the user's upper body 24 and used for flotation without being attached to the garment portion 12. The bladder 15, gas cartridge 62, and inflation tube 68 may optionally all be stored within an internal pocket inside the garment portion 12, such as pocket 56, while the bladder 15 is attached to the garment portion 12 by snap fasteners 110A and 110B.

A method of using the garment 10 for flotation is also provided. To this end, the garment 10 may be converted from the garment configuration 16 into the flotation configuration 18 by first removing the first and second straps 42, 44 from around the waist of the user 20 when the garment 10 is being worn on the user's lower body 22. The straps 42, 44 may be removed from around the user's waist by detaching the end 51 of each belt loop 50 that is attached to the garment portion 12 in order to release each of the straps 42, 44 from the all of the belt loops 50, as best seen in FIGS. 7 and 8. False belt loop 53 may also be separated from the garment portion 12. The garment 10 may then be removed from the user's lower body 22. The flotation device 14 may then be placed around the user's neck with the bladder portions 30 being positioned generally over the user's chest on opposite sides of the user's chest, as shown in FIG. 9. The garment portion 12 may remain attached to the flotation device 14 throughout the process. The straps 42, 44 may then be looped around the user's upper body 22 by extending each strap 42, 44 from the flotation device on the back side of the user's neck downward, under the user's arms, and then around the front of the user's chest. Each strap 42, 44 may then be placed through one of the loops 34 attached to the bladder portions 30. The flotation device 14 may then be harnessed to the user's upper body 22 by removably attaching first and second fastener members 46A and 46B to each other, which preferably comprises interlocking the male and female members of the side release buckle 46, as shown in FIG. 9. The straps 42, 44 may be tightened, if necessary, using the buckle slide 47. Lastly, the bladder 15 may be inflated to provide flotation, as shown in FIG. 10.

In a preferred embodiment, the garment 10 may comprise one or more additional exterior pockets 96, which may be sized and shaped for specific purposes, as shown in FIG. 1. For instance, pocket 96A may be sized and shaped to receive a small flashlight or penlight therein. Pocket 96B may be sized and shaped to receive an emergency locator beacon. In one embodiment, pocket 96B may include a clip 99 designed to be compatible with a fastening element on the emergency locator beacon in order to securely attach the beacon to the garment 10 and thus to the user 20 wearing the garment 10 in either the garment configuration 16 or the flotation configuration 18. Either of pockets 96C may be sized and shaped to receive a signaling mirror therein. Pocket 96D may be sized and shaped to receive a pair of pliers therein, such as pliers that are commonly used when fishing. Pocket 96D may have an open bottom to function as a sleeve for holding the pliers.

Pockets 96C may each be closable by specially designed snap fasteners 97, 98. For instance, in a preferred embodiment, snap fastener 97 may be designed to contain a wireless RTLS (real-time locating system) tag within a sealed internal compartment of the snap fastener 97. The RTLS tracking tag is operatively connected to an electronic anchor watch system designed to create an electronic security zone within a defined area surrounding a boat. The anchor watch system may include a receiver attached to the boat, and the RTLS tag may include a transmitter configured to transmit a wireless signal to the receiver to indicate the real-time location of the RTLS tag relative to the receiver. The system may utilize ultra-wideband (UWB) radio technology for communication between the tracking tag and the receiver. The tracking tag and anchor watch system may be configured to trip an alarm if the tag leaves the security zone. Thus, if a user 20 goes overboard and exits the security zone while wearing the garment 10 in either the garment configuration 16 or the flotation configuration 18, an alarm will sound and thereby alert others on the boat that the user 20 is no longer on the boat. Snap fastener 98 may optionally be designed to contain a compass for general navigational purposes.

It will be appreciated that the configurations and methods shown and described herein are illustrative only, and that these specific examples are not to be considered in a limiting sense, because numerous variations are possible. The subject matter of the present disclosure includes all novel and non-obvious combinations and sub-combinations of the various systems and configurations, and other features, functions, and/or properties disclosed herein. It is understood that versions of the invention may come in different forms and embodiments. Additionally, it is understood that one of skill in the art would appreciate these various forms and embodiments as falling within the scope of the invention as disclosed herein.

What is claimed is:

1. A garment, comprising:

a garment portion and a flotation device attached to the garment portion, wherein the flotation device comprises an inflatable bladder, wherein the garment is configured to convert between a garment configuration in which the garment is worn on a user's lower body and a flotation configuration in which the flotation device is harnessed to the user's upper body, wherein the garment portion comprises two leg portions designed to at least partially cover legs of the user when the garment is worn in the garment configuration, wherein the inflatable bladder comprises two opposing bladder portions, wherein each of the bladder portions is disposed at least partially within a respective one of the leg portions, wherein each of the bladder portions has a loop attached to a lower end of the bladder portion, wherein the garment further comprises a first strap and a second strap each attached to the garment, wherein the first strap has a first fastener member attached to the first strap and the second strap has a second fastener member attached to the second strap, wherein the first and second fastener members are designed to removably attach to each other, and wherein the first and second straps are configured to loop around a waist of the user to removably attach the first and second fastener members to each other on a front side of the garment when the garment is worn in the garment configuration, and wherein the first and second straps are configured to harness the flotation device to the user's upper body when the garment is converted into the flotation configuration.

2. The garment of claim 1, wherein the garment portion further comprises a plurality of belt loops, wherein one end of each of the belt loops is removably attached to the garment portion.

3. The garment of claim 1, wherein the first and second straps are attached to an upper end of the flotation device.

4. The garment of claim 1, wherein first and second fastener members comprise male and female members, respectively, of a side release buckle.

5. The garment of claim 1, wherein the loop attached to the lower end of each respective bladder portion of the inflatable bladder is sized to receive one of the first and second straps therethrough.

6. The garment of claim 1, wherein the garment portion further comprises an internal pocket sized and shaped to receive at least a portion of the inflatable bladder therein, wherein the internal pocket has two opposing lower open ends, wherein each bladder portion is extendable through a respective one of the lower open ends.

7. The garment of claim 1, wherein each bladder portion comprises a hook and loop fastener configured to removably secure the bladder portion in a folded configuration within a respective one of the leg portions of the garment portion.

8. The garment of claim 1, wherein the garment further comprises an internal zipper comprising a first zipper element and a second zipper element configured to interlock with the first zipper element, wherein the first zipper element is attached to an interior of the garment portion, wherein the second zipper element is attached to the inflatable bladder, and wherein the zipper is configured to removably attach the flotation device to the garment portion.

9. The garment of claim 1, wherein the flotation device further comprises a gas cartridge configured to inflate the inflatable bladder upon activation by the user, wherein the gas cartridge is disposed within an exterior pocket of the garment portion.

10. The garment of claim 1, wherein the flotation device further comprises an oral inflation tube configured to inflate the inflatable bladder, wherein the oral inflation tube is disposed within an exterior pocket of the garment portion.

11. The garment of claim 1, wherein the garment portion comprises a pair of shorts or trousers.

12. The garment of claim 1, wherein the garment portion comprises a front half and a rear half, wherein the front half is removably attached to the rear half on a first side of the garment portion by a first pair of strips of a first hook and loop fastener, wherein the front half is also removably attached to the rear half on an opposing second side of the garment portion by a second pair of strips of a second hook and loop fastener, wherein the garment is designed to be removed from the user's lower body by separating the first pair of strips of the first hook and loop fastener and the second pair of strips of the second hook and loop fastener.

13. The garment of claim 1, wherein the lower end of each respective one of the bladder portions of the inflatable bladder is internally retracted into a shortened configuration, wherein the lower end of each respective one of the bladder portions is configured to automatically extend to a lengthened configuration upon inflation of the inflatable bladder.

14. The garment of claim 1, wherein the garment portion comprises a first pair of snap fastener elements each attached to the garment portion, wherein the flotation device comprises a second pair of snap fastener elements each attached to the inflatable bladder, wherein the first and second pairs of snap fastener elements are designed to interlock in a snap fit relation to removably attach the flotation device to the garment portion.

15. A method of using a garment for flotation, said method comprising the steps of:

providing a garment, comprising:

a garment portion and a flotation device attached to the garment portion, wherein the flotation device comprises an inflatable bladder, wherein the garment is configured to convert between a garment configuration in which the garment is worn on a user's lower body and a flotation configuration in which the flotation device is harnessed to the user's upper body, wherein the garment portion comprises two leg portions designed to at least partially cover legs of the user when the garment is worn in the garment configuration, wherein the inflatable bladder comprises two opposing bladder portions, wherein each of the bladder portions is disposed at least partially within a respective one of the leg portions, wherein each of the bladder portions has a loop attached to a lower end of the bladder portion, wherein the garment further comprises a first strap and a second strap each attached to the garment, wherein the first strap has a first fastener member attached to the first strap and the second strap has a second fastener member attached to the second strap, wherein the first and second fastener members are designed to removably attach to each other, and wherein the first and second straps are configured to loop around a waist of the user to removably attach the first and second fastener members to each other on a front side of the garment when the garment is worn in the garment configuration, and wherein the first and second straps are configured to harness the flotation device to the user's upper body when the garment is converted into the flotation configuration; and converting the garment from the garment configuration into the flotation configuration by the steps of:

removing the first and second straps from around the waist of the user;

removing the garment from the user's lower body;

placing the flotation device around a neck of the user with the bladder portions being generally positioned over opposing sides of a chest of the user;

looping each of the first and second straps from a back side of the user's upper body, under a respective one of opposing arms of the user, and then around a front side of the user's chest placing each of the first and second straps through a respective one of the loops attached to each of the bladder portions;

harnessing the flotation device to the user's upper body by removably attaching the first fastener member of the first strap to the second fastener member of the second strap; and inflating the inflatable bladder.

16. The method of claim 15, wherein the garment portion further comprises a plurality of belt loops, wherein one end of each of the belt loops is removably attached to the garment portion, wherein the step of removing the first and second straps from around the waist of the user comprises detaching the end of each belt loop that is removably attached to the garment portion to release each of the first and second straps from the plurality of belt loops.

17. The method of claim 15, wherein first and second fastener members comprise male and female members, respectively, of a side release buckle, wherein the step of removably attaching the first fastener member to the second fastener member comprises interlocking the male and female members of the side release buckle.

18. The method of claim 15, wherein each bladder portion comprises a hook and loop fastener configured to removably secure the bladder portion in a folded configuration within a respective one of the leg portions of the garment portion, wherein the method further comprises the step of fully extending each bladder portion by unfolding each bladder portion after the step of removing the garment from the user's lower body.

19. The method of claim 15, wherein the flotation device further comprises a gas cartridge configured to inflate the inflatable bladder upon activation by the user, wherein the gas cartridge is disposed within an exterior pocket of the garment portion, wherein the step of inflating the inflatable bladder comprises activating the gas cartridge to release compressed gas into the inflatable bladder.

20. The method of claim 15, wherein the flotation device further comprises an oral inflation tube configured to inflate the inflatable bladder, wherein the oral inflation tube is disposed within an exterior pocket of the garment portion, wherein the step of inflating the inflatable bladder comprises the user exhaling into the oral inflation tube to manually inflate the inflatable bladder.

* * * * *